US007154213B2

(12) United States Patent
Nakamura et al.

(10) Patent No.: US 7,154,213 B2
(45) Date of Patent: Dec. 26, 2006

(54) GROUND ELECTRODE STRUCTURE OF A SPARK PLUG FOR A GAS ENGINE

(75) Inventors: Toshiya Nakamura, Toyokawa (JP); Koji Yamanaka, Kariya (JP); Yoichi Matsushita, Osaka (JP); Yasunori Goda, Osaka (JP)

(73) Assignee: Denso Corporation (JP)

( * ) Notice: Subject to any disclaimer, the term of this patent is extended or adjusted under 35 U.S.C. 154(b) by 148 days.

(21) Appl. No.: 10/945,876

(22) Filed: Sep. 22, 2004

(65) Prior Publication Data

US 2005/0062385 A1 Mar. 24, 2005

(30) Foreign Application Priority Data

Sep. 24, 2003 (JP) ..... 2003-331539

(51) Int. Cl.
*H01T 13/20* (2006.01)

(52) U.S. Cl. ..... 313/141; 313/118; 313/143

(58) Field of Classification Search ..... 313/118, 313/141–144; 123/169 EL
See application file for complete search history.

(56) References Cited

U.S. PATENT DOCUMENTS 5,877,584 A * 3/1999 Kato et al. ..... 313/143
5,982,080 A * 11/1999 Shibata et al. ..... 313/141
5,990,602 A * 11/1999 Katoh et al. ..... 313/141
6,720,716 B1 * 4/2004 Shibata et al. ..... 313/141
2002/0003389 A1 1/2002 Ishiguro ..... 313/141

FOREIGN PATENT DOCUMENTS

JP 2000-40577 2/2000
JP 2002-93547 3/2002
JP 2002-313523 10/2002

* cited by examiner

*Primary Examiner*—Nimeshkumar D. Patel
*Assistant Examiner*—Kevin Quarterman
(74) *Attorney, Agent, or Firm*—Nixon & Vanderhye PC

(57) ABSTRACT

A spark plug for a gas engine includes a ground electrode body and a center electrode body. A ground electrode of the ground electrode body is welded on a surface of a ground electrode base material opposing to the center electrode body. The ground electrode protrudes toward the center electrode body. The ground electrode is made of a material containing iridium or platinum as a main component. The ground electrode base material is made of a heat-resistant nickel alloy. The ground electrode is impacted in a recess of the ground electrode base material. The spark plug satisfies a condition $0.3 \leqq h/H \leqq 0.5$ when H represents the thickness of the ground electrode base material in an intrusion direction of the ground electrode, and h represents an intrusion length of the ground electrode that defines a length of the ground electrode impacted in the ground electrode base material in the intrusion direction.

15 Claims, 5 Drawing Sheets

GROUND ELECTRODE STRUCTURE OF A SPARK PLUG FOR A GAS ENGINE

BACKGROUND OF THE INVENTION

This application is based upon and claims the benefit of priority of the prior Japanese Patent Application 2003-331539 filed on Sep. 24, 2003.

The present invention relates to a spark plug for a gas engine which is equipped with a ground electrode body and a center electrode body.

The Japanese Patent Application Laid-open No. 2002-93547 (corresponding to the U.S. patent application Publication 2002/0003389 A1) discloses a conventional spark plug for a gas engine that includes a ground electrode body and a center electrode body. A ground electrode of the ground electrode body is made of a material containing iridium as a main component. The ground electrode is welded on a surface of a ground electrode base material opposing to the center electrode body. The ground electrode protrudes toward the center electrode body. The ground electrode base material is made of a heat-resistant nickel alloy. The ground electrode is impacted in a recess of the ground electrode base material.

According to this conventional spark plug for a gas engine, there is no evaluation with respect to the relationship between the thickness of the ground electrode base material in an intrusion direction of the ground electrode (hereinafter, simply referred to as the thickness of the ground electrode base material) and the intrusion length of the ground electrode that represents the length of a portion of the ground electrode intruded into the ground electrode base material in the intrusion direction (hereinafter, simply referred to as the intrusion length of the ground electrode).

Furthermore, the Japanese Patent Application Laid-open No. 2002-313523 discloses another conventional spark plug for a gas engine that includes a ground electrode of the ground electrode body and a center electrode of the center electrode body which are made of a material containing iridium or platinum as a main component. This conventional spark plug satisfies a condition D1/D2>0.9 when the diameter of the ground electrode is D1 and the diameter of the center electrode is D2.

In general, the spark plug for a gas engine is subjected to high-temperature environments. The above-described conventional spark plugs are dissatisfactory in the durability when they are subjected to the high-temperature environments as described below.

For example, the spark plug for a gas engine is disposed in a sub combustion chamber of an indirect lean burn gas engine. In this case, the gas mixture having a high concentration is introduced into the sub combustion chamber and accordingly the temperature of the sub combustion chamber becomes very high. Therefore, when the spark plug is used in the indirect lean burn gas engine, the spark plug is forcibly subjected to very severe high-temperature environments (e.g., 800° C. or above).

When no evaluation is given with respect to the relationship between the thickness of the ground electrode base material and the intrusion length of the ground electrode, there is a possibility that the durability of the ground electrode body is dissatisfactory.

It is now assumed that the intrusion length of the ground electrode is excessively short relative to the thickness of the ground electrode base material. In other words, when the depth of the ground electrode intruded into the ground electrode base material is very shallow, the strength for holding the ground electrode with the ground electrode base material is insufficient. The ground electrode tends to fall off the ground electrode base material. The durability of the ground electrode body is not good.

Furthermore, to increase the strength for holding the ground electrode with the ground electrode base material, it may be possible to increase the ratio of the intrusion length of the ground electrode to the thickness of the ground electrode base material. In other words, the depth of the ground electrode intruded into the ground electrode base material may be increased.

However, there is a significant difference in the thermal expansion coefficient between the ground electrode and the ground electrode base material. The ground electrode is made of a material containing iridium or platinum as a main component, while the ground electrode base material is made of a heat-resistant nickel alloy. The heat-resistant nickel alloy has a larger thermal expansion coefficient. As described above, when installed in a gas engine, the ground electrode body is forcibly subjected to the high-temperature environment. A significant amount of thermal expansion will occur between the ground electrode and the ground electrode base material which are welded together.

If the depth of the ground electrode intruded into the ground electrode base material is excessively deep, the ground electrode base material will cause an undesirable warpage or swell at a back surface which is opposite to the inner surface on which the ground electrode is intruded. An undesirable stress will act on the bonded portion of the ground electrode and the ground electrode base material which are welded together.

Accordingly, when the depth of the ground electrode intruded into the ground electrode base material is excessively deep, the ground electrode tends to fall off the ground electrode base material. The durability of the ground electrode body is dissatisfactory.

On the other hand, when the ratio D1/D2 of the diameter D1 of the ground electrode to the diameter D2 of the center electrode is set to be larger than 0.9, the ratio D1/D2 may have a small value and accordingly the ground electrode may have a very small diameter D1. In this case, the spark discharge tends to occur between the center electrode and the ground electrode base material. It is needless to say that the spark discharge should occur between the center electrode and the ground electrode. The ground electrode base material is not the member for causing the spark discharge. The ground electrode base material is the member supporting the ground electrode.

If the spark discharge occurs between the center electrode and the ground electrode base material, the ground electrode base material will be forcibly subjected to the high-temperature environment and will wear rapidly due to high-temperature oxidation. The required discharge voltage will increase when the spark plug is used for a long time. Such a spark plug for a gas engine will have insufficient durability.

SUMMARY OF THE INVENTION

In view of the above-described problems, the present invention has an object to provide a spark plug for a gas engine which is excellent in the heat durability.

In order to accomplish the above and other related objects, the present invention provides a first spark plug for a gas engine including a ground electrode body and a center electrode body, wherein a ground electrode of the ground electrode body is welded on a surface of a ground electrode base material opposing to the center electrode body. The ground electrode of the ground electrode body protrudes toward the center electrode body. The ground electrode is made of a material containing iridium or platinum as a main component. The ground electrode base material is made of a heat-resistant nickel alloy. The ground electrode is impacted in a recess of the ground electrode base material. And, the first spark plug of this invention satisfies the condition $0.3 \leqq h/H \leqq 0.5$ when H represents a thickness of the ground electrode base material in an intrusion direction of the ground electrode, and h represents an intrusion length of the ground electrode that defines a length of the ground electrode impacted in the ground electrode base material in the intrusion direction.

Furthermore, to accomplish the above and other related objects, the present invention provides a second spark plug for a gas engine including a ground electrode body and a center electrode body, wherein a ground electrode of the ground electrode body and a center electrode of the center electrode body are made of a material containing iridium or platinum as a main component. And, the second spark plug of this invention satisfies the condition $D1/D2 \geqq 1.1$ when D1 represents a diameter of the ground electrode and D2 represents a diameter of the center electrode.

Furthermore, to accomplish the above and other related objects, the present provides a third spark plug for a gas engine including a ground electrode body and a center electrode body, wherein a ground electrode of the ground electrode body and a center electrode of the center electrode body are made of a material containing iridium or platinum as a main component. The ground electrode protrudes toward the center electrode body. The ground electrode base material is made of a heat-resistant nickel alloy. The ground electrode is impacted in a recess of the ground electrode base material. And, the third spark plug of this invention satisfies the conditions $D1/D2 \geqq 1.1$ and $0.3 \leqq h/H \leqq 0.5$ when D1 represents a diameter of the ground electrode, D2 represents a diameter of the center electrode, H represents a thickness of the ground electrode base material in an intrusion direction of the ground electrode, and h represents an intrusion length of the ground electrode that defines a length of the ground electrode impacted in the ground electrode base material in the intrusion direction.

According to the first or third spark plug of this invention, it is preferable that a condition $h>0.5$ mm is further satisfied. The ground electrode is bonded to the ground electrode base material by laser welding.

According to the second or third spark plug of this invention, it is preferable that the center electrode has a surface opposing to the ground electrode, and a groove is formed on the surface of the center electrode.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
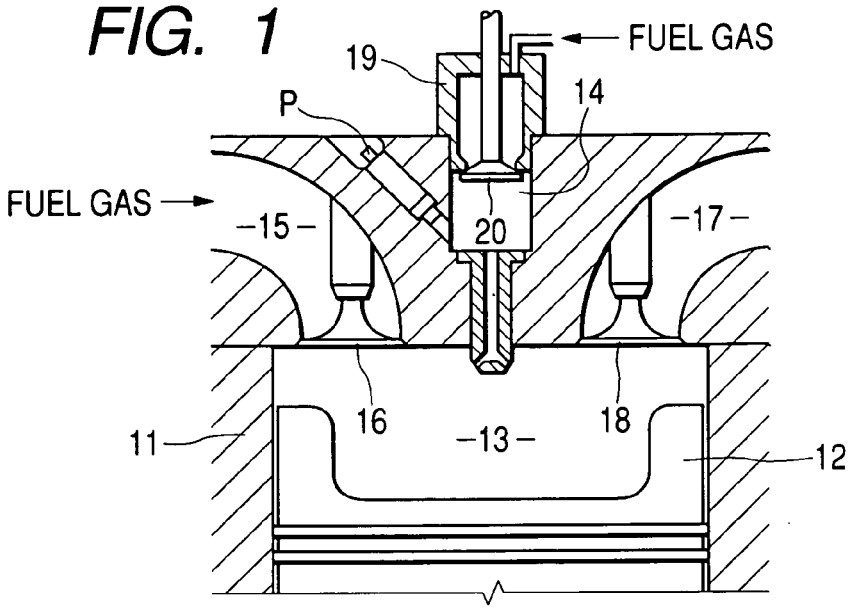
FIG. 1 is a schematic view showing an indirect lean burn gas engine.

To improve the durability of the spark plug for a gas engine, the inventors of this application have experimentally manufactured a ground electrode of a ground electrode body made of a material containing iridium or platinum as a main component. The inventors have experimentally welded the ground electrode on a surface of a ground electrode base material opposing to a center electrode body, so that the ground electrode protrudes toward the center electrode body. The ground electrode base material is made of a heat-resistant nickel alloy. The ground electrode is impacted in a recess of the ground electrode base material.

Through various experiments and tests for optimizing the dimensions of the spark plug, the inventors have come to the conclusion that it is desirable to satisfy the condition $0.3 \leqq h/H \leqq 0.5$, when H represents the thickness of the ground electrode base material in an intrusion direction of the ground electrode, and h represents an intrusion length of the ground electrode that defines a length of the ground electrode impacted in the ground electrode base material in the intrusion direction.

The inventors have confirmed that the above setting for the ratio h/H is effective in improving the durability of the ground electrode body. And, the inventors have confirmed that the durability of the spark plug for a gas engine can be improved.

When the ratio h/H of the intrusion length h of the ground electrode to the thickness H of the ground electrode base material is smaller than 0.3, the depth of the ground electrode intruded in the ground electrode base material is excessively shallow. The strength for holding the ground electrode with the ground electrode base material is insufficient. The ground electrode tends to fall off the ground electrode base material.

When the ratio h/H is greater than 0.5, the depth of the ground electrode intruded in the ground electrode base material is excessively deep. The ground electrode body is subjected to high-temperature environments. A thermal expansion difference will increase between the ground electrode and the ground electrode base material which are welded together. The ground electrode base material may warp and accordingly the ground electrode tends to fall off the ground electrode base material.

Considering the above experimental or test results, the inventors of this application have finally optimized the dimensions of the spark plug for a gas engine. In this optimization, the strength for holding the ground electrode with the ground electrode base material should be sufficiently large. The ground electrode base material should be prevented from warping when it is subjected to high-temperature environments.

To this end, the inventors have determined the condition $0.3 \leqq h/H \leqq 0.5$ in the ratio h/H of the intrusion length h of the ground electrode to the thickness H of the ground electrode base material, in order to prevent the ground electrode from falling off the ground electrode base material.

The inventors have confirmed that satisfying the condition $0.3 \leqq h/H \leqq 0.5$ in the ratio h/H of the intrusion length h of the ground electrode to the thickness H of the ground electrode base material is effective in improving the durability of the spark plug for a gas engine.

In view of the foregoing, the inventors of this application provide a first spark plug for a gas engine including a ground electrode body and a center electrode body. According to the first spark plug of this invention, a ground electrode of the ground electrode body is welded on a surface of a ground electrode base material opposing to the center electrode body. The ground electrode of the ground electrode body protrudes toward the center electrode body. The ground electrode is made of a material containing iridium or platinum as a main component. The ground electrode base material is made of a heat-resistant nickel alloy. The ground electrode is impacted in a recess of the ground electrode base material. And, the first spark plug satisfies the condition $0.3 \leqq h/H \leqq 0.5$ when H represents the thickness of the ground electrode base material in an intrusion direction of the ground electrode, and h represents an intrusion length of the ground electrode that defines a length of the ground electrode impacted in the ground electrode base material in the intrusion direction.

Furthermore, to improve the durability of the spark plug for a gas engine, the inventors of this application have experimentally manufactured a ground electrode of a ground electrode body and a center electrode of a center electrode body with a material containing iridium or platinum as a main component. Through various experiments and tests for optimizing the dimensions of the spark plug, the inventors have come to the conclusion that it is desirable to satisfy the condition $D1/D2 \geqq 1.1$ when D1 represents the diameter of the ground electrode and D2 represents the diameter of the center electrode.

The inventors have confirmed that the above setting for the ratio D1/D2 is effective in preventing the ground electrode base material from wearing even when the spark plug is used for a long time and also in preventing the required discharge voltage from increasing even when the spark plug is used for a long time. Furthermore, the inventors have confirmed that the durability of the spark plug for a gas engine can be surely improved.

When the ratio D1/D2 of the diameter D1 of the ground electrode to the diameter D2 of the center electrode is equal to or greater than 1.1, the ground electrode has a large diameter. This is effective in preventing the spark discharge from occurring between the center electrode and the ground electrode base material. Thus, the spark discharge surely occurs between the center electrode and the ground electrode. The second spark plug of this invention can prevent the ground electrode base material from wearing even when the spark plug is used for a long time and also can prevent the required discharge voltage from increasing even when the spark plug is used for a long time. Accordingly, it becomes possible to provide a spark plug for a gas engine having excellent when the ratio D1/D2 of the diameter D1 of the ground electrode to the diameter D2 of the center electrode satisfies a condition $D1/D2 \geqq 1.1$.

In view of the foregoing, the inventors of this application provide a second spark plug for a gas engine including a ground electrode body and a center electrode body. According to the second spark plug of this invention, a ground electrode of the ground electrode body and a center electrode of the center electrode body are made of a material containing iridium or platinum as a main component. And, the second spark plug satisfies the condition $D1/D2 \geqq 1.1$ when D1 represents a diameter of the ground electrode and D2 represents a diameter of the center electrode.

Moreover, to improve the durability of the spark plug for a gas engine, the inventors of this application have experimentally manufactured a ground electrode of a ground electrode body and a center electrode of a center electrode body with a material containing iridium or platinum as a main component. The inventors have experimentally welded the ground electrode on a surface of a ground electrode base material opposing to a center electrode body, so that the ground electrode protrudes toward the center electrode body. The ground electrode base material is made of a heat-resistant nickel alloy. The ground electrode is impacted in a recess of the ground electrode base material.

Through various experiments and tests for optimizing the dimensions of the spark plug, the inventors have come to the conclusion that it is desirable to satisfy both of the conditions $D1/D2 \geqq 1.1$ and $0.3 \leqq h/H \leqq 0.5$. The inventors have confirmed that the above setting for the ratio D1/D2 is effective in preventing the ground electrode base material from wearing even when the spark plug is used for a long time and also in preventing the required discharge voltage from increasing even when the spark plug is used for a long time. Furthermore, the inventors have confirmed that the above setting for the ratio h/H is effective in improving the durability of the ground electrode body. Thus, the inventors have confirmed that the durability of the spark plug for a gas engine can be improved due to synergistic effects of the above settings.

Namely, the inventors have determined the condition $D1/D2 \geqq 1.1$ in the ratio D1/D2 of the diameter D1 of the ground electrode to the diameter D2 of the center electrode so as to prevent the spark discharge from occurring between the center electrode and the ground electrode base material and also prevent the ground electrode base material from wearing even when the spark plug is used for a long time.

Furthermore, the inventors have determined the condition $0.3 \leqq h/H \leqq 0.5$ in the ratio h/H of the intrusion length h of the ground electrode to the thickness H of the ground electrode base material so as to assure a sufficient strength for holding the ground electrode with the ground electrode base material and also prevent the ground electrode base material from warping when it is subjected to high-temperature environment, and further to prevent ground electrode from falling off the ground electrode base material.

The inventors have confirmed that satisfying the condition $D1/D2 \geqq 1.1$ in the ratio D1/D2 of the diameter D1 of the ground electrode to the diameter D2 of the center electrode as well as satisfying the condition $0.3 \leqq h/H \leqq 0.5$ in the ratio h/H of the intrusion length h of the ground electrode to the thickness H of the ground electrode base material is effective in improving the durability of the spark plug for a gas engine.

In view of the foregoing, the inventors of this application provide a third spark plug for a gas engine including a ground electrode body and a center electrode body. According to the third spark plug, a ground electrode of the ground electrode body and a center electrode of the center electrode body are made of a material containing iridium or platinum as a main component. The ground electrode protrudes toward the center electrode body. The ground electrode base material is made of a heat-resistant nickel alloy. The ground electrode is impacted in a recess of the ground electrode base material. And, the third spark plug satisfies the conditions $D1/D2 \geqq 1.1$ and $0.3 \leqq h/H \leqq 0.5$ when D1 represents a diameter of the ground electrode, D2 represents a diameter of the center electrode, H represents the thickness of the ground electrode base material in an intrusion direction of the ground electrode, and h represents an intrusion length of the ground electrode that defines a length of the ground electrode impacted in the ground electrode base material in the intrusion direction.

In the first and third spark plug of this invention, it is preferable that a condition h>0.5 mm is further satisfied.

More specifically, when the intrusion length h of the ground electrode is greater than 0.5 mm, the ground electrode can be firmly welded with the ground electrode base material under the condition that the ground electrode is sufficiently intruded in the ground electrode base material.

Namely, in welding the ground electrode with the ground electrode base material under the condition that the ground electrode is intruded in the ground electrode base material, the bonding strength between the ground electrode and the ground electrode base material becomes large when the length of a fusing region between them is long in the intrusion direction.

According to various experimental or test results, when the intrusion length h of the ground electrode is greater than 0.5 mm, it is possible to assure a sufficient length of the fusing portion in the intrusion direction for assuring a satisfactory strength between the ground electrode and the ground electrode base material. When the intrusion length h of the ground electrode is less than 0.5 mm, it is difficult to obtain a sufficient length of the fusing portion in the intrusion direction for assuring a satisfactory bonding strength.

In the first and third spark plug of this invention, it is preferable that the ground electrode is bonded to the ground electrode base material by laser welding.

When and the ground electrode and the ground electrode base material are bonded by laser welding, the ground electrode and the ground electrode base material can be firmly bonded. The laser welding enables the members to be bonded together to fuse at their limited regions at higher temperatures to provide a rigid and reliable connection between them. The ground electrode and the ground electrode base material are basically small members. Using the laser welding is effective in accurately and firmly bonding these members at a designated portion. The bonding strength between the ground electrode and the ground electrode base material can be enhanced. Accordingly, the durability of the spark plug for a gas engine can be improved.

In the second and third spark plug of this invention, it is preferable that the center electrode has a surface opposing to the ground electrode, and a groove is formed on the surface of the center electrode.

The center electrode has an angled or edged portion along the periphery of its circular surface opposing to the ground electrode. Additionally, the groove is provided on the surface of the center electrode. Thus, the spark discharge occurs at the groove on the opposed surface as well as at the angled or edged portion in the periphery of the cylindrical center electrode. In other words, it becomes possible to increase the number of portions where the spark discharge occurs. Therefore, it becomes possible to reduce the required discharge voltage.

More specifically, the spark discharge occurs between the center electrode and the ground electrode. The spark discharge starts growing from any angled or edged portion existing on a surface of the center electrode opposing to the ground electrode.

Forming a groove on the surface of the center electrode opposing to the ground electrode is effective in causing the spark discharge to grow from any angled or edged portion of this groove. Meanwhile, the spark discharge occurs from the angled or edged portion formed in the periphery of the cylindrical center electrode. Accordingly, the spark discharge occurs at numerous portions. The required discharge voltage can be reduced. When the required discharge voltage is low, it is possible to prevent the required discharge voltage from reaching its upper limit. Thus, the durability of the spark plug for a gas engine can be improved.

Hereinafter, practical embodiments of the present invention will be explained with reference to attached drawings.

First Embodiment

A first embodiment of the present invention will be explained with reference to attached drawings.

FIG. 1 shows an indirect lean burn gas engine equipped with a spark plug P for a gas engine in accordance with the present invention.

The gas engine, as shown in FIG. 1, includes a cylinder 11 and a piston 12 reciprocating in this cylinder 11. The cylinder 11 and the piston 12 cooperatively form a main combustion chamber 13 at the top side of the piston 12. A sub combustion chamber 14, having a volume smaller than that of the main combustion chamber 13, is provided in a cylinder head so as to communicate with the main combustion chamber 13. The gas engine has an intake port 15 connected to the main combustion chamber 13 and an intake valve 16 provided in the intake port 15. The gas engine has an exhaust port 17 connected to the main combustion chamber 13 and an exhaust valve 18 provided in the exhaust port 17. A sub combustion gas port 19 communicates with the sub combustion chamber 14. A sub combustion gas valve 20 is provided in the sub combustion gas port 19. The spark plug P, provided adjacent to the sub combustion chamber 14, ignites the gas mixture introduced in the sub combustion chamber 14.

In the intake stroke, the fuel gas is supplied from the sub combustion gas port 19 into the sub combustion chamber 14. Meanwhile, the premixed gas mixture having an excess air ratio $\lambda$ greater than 1.7 is supplied from the intake port 15 into the main combustion chamber 13, thereby realizing the combustion of a lean gas mixture.

Furthermore, the gas engine of this embodiment is a Miller cycle engine. More specifically, in the intake stroke, the piston 12 moves downward until it reaches the bottom dead center. Then, after passing the bottom dead center, the piston 12 moves upward by a predetermined amount (e.g. approximately ½ stroke) before the intake valve 16 and the sub combustion gas valve 20 are closed. Subsequently, the piston 12 goes into the compression stroke and continuously moves upward. When the piston 12 almost reaches the top dead center, the spark plug P is activated to ignite the gas mixture stored in the sub combustion chamber 14. The flame grows throughout the sub combustion chamber 14 and enters into the main combustion chamber 13. This induces the combustion of the premixed gas mixture in the main combustion chamber 13. Then, the piston 12 is depressed downward and goes into the expansion stroke. In this expansion stroke, the piston 12 moves downward until it reaches the bottom dead center. Furthermore, the piston 12 goes into the exhaust stroke. According to the Miller cycle engine, the expansion ratio is set to be larger than the compression ratio to effectively suppress the knocking. The compression ratio is set somewhere in the range from 8 to 15.

Figure 2:
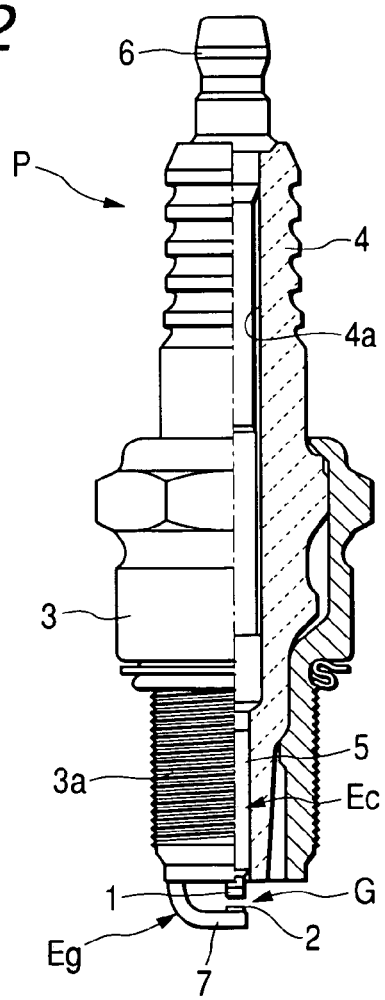
FIG. 2 is a half cross-sectional view showing a spark plug for a gas engine in accordance with a first embodiment of the present invention.

As shown in FIG. 2, the spark plug P has a center electrode 1 of the center electrode body Ec and a ground electrode 2 of the ground electrode body Eg which are opposed to each other via a discharge gap G. A housing 3 supports the ground electrode body Eg. The center electrode body Ec is inserted into a through-hole 4*a* of an insulator 4 held in the housing 3.

The housing 3, which is made of steel or a comparable metallic member, has a cylindrical shape. The housing 3 has a threaded portion 3*a* on its outer surface through which the spark plug P is securely fixed to the gas engine. The insulator 4, which is made of an alumina or a comparable insulating material, is inserted at one end into this housing 3. The through-hole 4*a* formed in the insulator 4 extends entirely in the axial direction of the housing 3.

Figure 3:
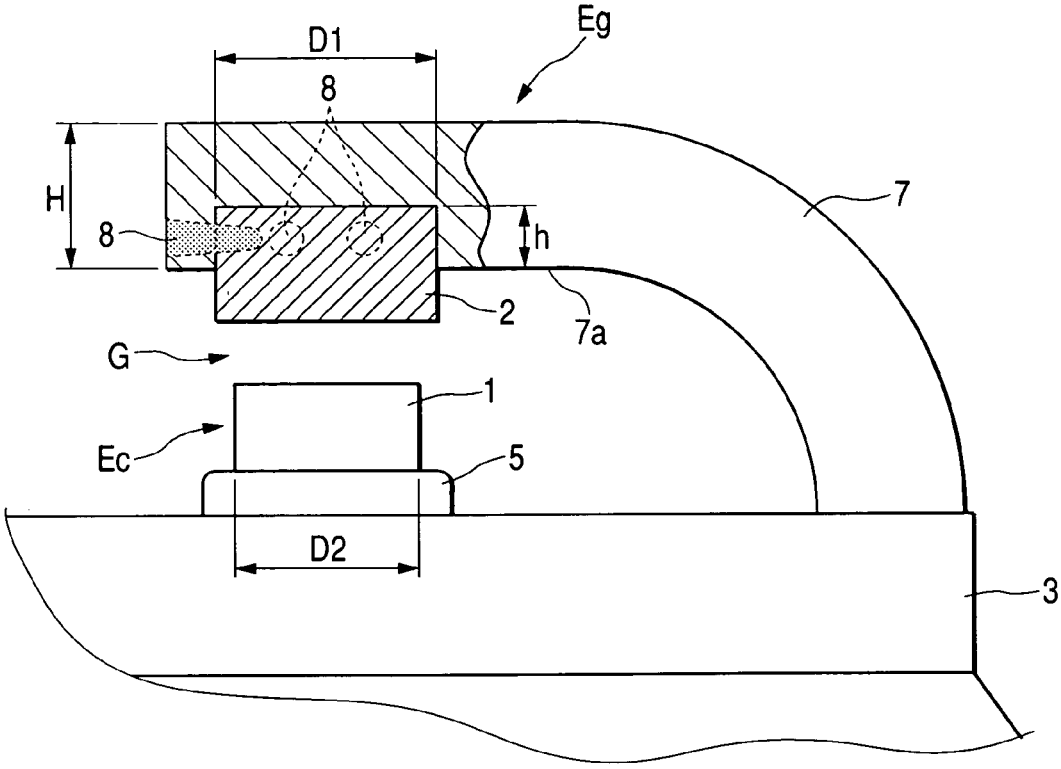
FIG. 3 is an enlarged side view showing a center electrode body and a ground electrode body of the spark plug for a gas engine in accordance with the first embodiment of the present invention.
Figure 4A:
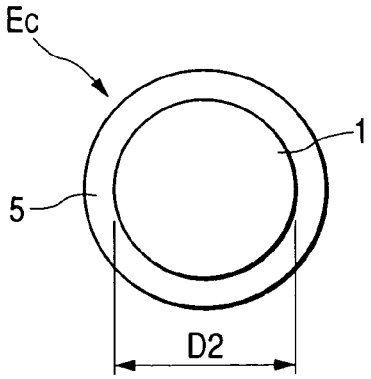
FIG. 4A is a view showing the center electrode body of the spark plug for a gas engine in accordance with the first embodiment of the present invention.
Figure 4B:
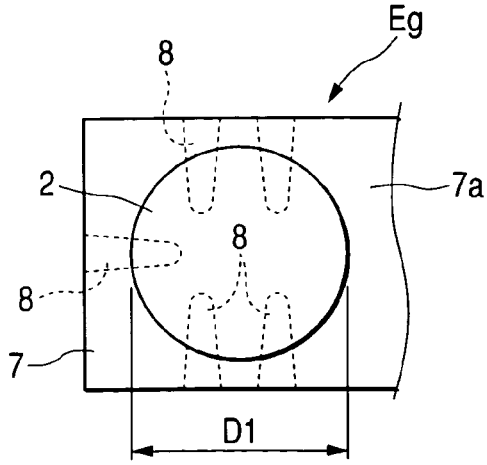
FIG. 4B is a view showing the ground electrode body of the spark plug for a gas engine in accordance with the first embodiment of the present invention.

As shown in FIGS. 3, 4A, and 4B, the center electrode body Ec includes the cylindrical center electrode 1 and a cylindrical center electrode base material 5 which are coaxially arranged and welded together. The cylindrical center electrode 1 is welded on the top surface of the cylindrical center electrode base material 5. FIG. 4A shows the center electrode body Ec seen from the ground electrode body Eg. FIG. 4B shows the ground electrode body Eg seen from the center electrode body Ec.

As shown in FIG. 2, the center electrode base material 5 is inserted from one end of the through-hole 4*a* of the insulator 4 and is held in the through-hole 4*a* of the insulator 4 so that the center electrode 1 protrudes out of the insulator 4. The center electrode body Ec is supported in the insulator 4 so that the center electrode body Ec is electrically insulated from the housing 3. Furthermore, a terminal portion 6 is inserted from the other end of the through-hole 4*a* of the insulator 4 and is held in the through-hole 4*a* of the insulator 4 so that the terminal portion 6 is electrically connected to the center electrode base material 5.

As shown in FIGS. 3, 4A, and 4B, the ground electrode body Eg includes the cylindrical ground electrode 2 protruding toward the center electrode body Ec. The ground electrode 2 is welded on a surface 7*a* of the ground electrode base material 7 opposing to the center electrode body Ec. The ground electrode 2 is intruded in the ground electrode base material 7.

The ground electrode base material 7 has an L-shaped configuration. The surface 7*a*, opposing to the center electrode body Ec, is positioned at the inner side of the ground electrode base material 7 and located at the distal end side of the ground electrode base material 7. The other end (i.e. the proximal end) of the ground electrode base material 7 is welded to the housing 3. Thus, the ground electrode body Eg is firmly fixed to the housing 3.

In other words, the ground electrode base material 7 has the inner surface 7*a* at its distal end side. This surface 7*a* opposes to the center electrode body Ec. The ground electrode 2 is bonded on this surface 7*a* of the ground electrode 2 by laser welding. The ground electrode 2 has a top surface protruding toward the center electrode body Ec and a bottom surface intruded in the ground electrode base material 7.

In laser welding the ground electrode 2 with the ground electrode base material 7, the ground electrode 2 is first placed in a recess of the ground electrode base material 7. Then, the laser beam is irradiated from plural points on the side surface of the ground electrode base material 7 into the ground electrode base material 7. A fused portion 8, formed as a result of the laser welding operation, extends laterally from the ground electrode 2 to the ground electrode base material 7. Thus, the ground electrode 2 and the ground electrode base material 7 are firmly bonded together.

The discharge gap G between the center electrode 1 and the ground electrode 2 can be set to an appropriate value, for example, in the range from 0.2 mm to 0.4 mm.

Both the center electrode 1 and the ground electrode 2 are made of a material containing Ir (iridium) as a main component. According to this embodiment, the center electrode 1 and the ground electrode 2 are made of an alloy containing Ir by approximately 90% and Rh (rhodium) by approximately 10%.

Although not shown in the drawings, each of the center electrode base material 5 and the ground electrode base material 7 consists of an external material and an internal material extending in the longitudinal direction. The external material is made of a heat-resistant nickel alloy such as inconel to improve the heat radiation property. The temperature of the center electrode 1 or the ground electrode 2 can be lowered. The internal material is made of a metal material having excellent thermal conductivity, such as copper.

As shown in FIG. 3, according to the first embodiment, the ground electrode body Eg and the center electrode body Ec satisfy the following conditions.

In FIG. 3, D1 represents the diameter of the ground electrode 2. D2 represents the diameter of the center electrode 1. H represents the thickness of the ground electrode base material 7 in the intrusion direction of the ground electrode 2. The intrusion direction of the ground electrode 2 is parallel to the axis of the spark plug P (i.e. the axis of the center electrode I or the ground electrode 2). Furthermore, h represents the intrusion length of the ground electrode 2 that represents the length of a portion of the ground electrode 2 intruded in the ground electrode base material 7 in the intrusion direction of the ground electrode 2.

According to this embodiment, the following conditions are satisfied.

$$D1/D2 \geqq 1.$$

$$0.3 \leqq h/H \leqq 0.5$$

When the diameter D2 of the center electrode 1 is large, it is possible to prevent the center electrode 1 from wearing when the spark plug is used for a long time. Accordingly, the required discharge voltage can be suppressed to a relatively low value. The durability of the spark plug P can be improved.

However, if the diameter D2 of the center electrode 1 is excessively large, the center electrode body Ec will be so large in size that the flame for the spark discharge may be cooled undesirably. The ignitability will be bad. It is desirable that the diameter D2 of the center electrode 1 is equal to or less than 2.0 mm.

The ratio D1/D2 of the diameter D1 of the ground electrode 2 to the diameter D2 of the center electrode 1 is set to be equal to or greater than 1.1.

When the diameter of the ground electrode 2 is large, it is possible to prevent the spark discharge from occurring between the center electrode 1 and the ground electrode base material 7. The spark discharge should occur between the center electrode 1 and the ground electrode 2. It becomes possible to prevent the ground electrode base material 7 from wearing when the spark plug is used for a long time. The required discharge voltage can be suppressed at a relatively low level.

However, as described later, the durability of the spark plug P remains substantially constant even when the ratio D1/D2 of the diameter D1 of the ground electrode 2 to the diameter D2 of the center electrode 1 is increased to 1.2 or above. Accordingly, in order to avoid the undesirable expansion in size of the ground electrode body Eg, it is desirable to set the condition D1/D2≦1.2. This setting assures a sufficiently large diameter D1 of the ground electrode 2 and brings reliable durability of the spark plug P.

Namely, the undesirable expansion in size of the center electrode 1 or the ground electrode 2 should be avoided. The ignitability should be maintained adequately. The durability of the spark plug P should be improved. It is now assumed that the diameter D2 of the center electrode 1 is 2.0 mm.

Considering the above factors, it is desirable that the ratio D1/D2 of the diameter D1 of the ground electrode 2 to the diameter D2 of the center electrode 1 satisfies the condition 1.1≦D1/D2≦1.2.

Furthermore, when the thickness H of the ground electrode base material 7 is large, the ground electrode body Eg can possess a sufficient strength.

However, if the thickness H of the ground electrode base material 7 is excessively large, the ground electrode body Eg will be so large in size that the spark plug P cannot be manufactured easily. Considering this drawback, it is desirable that the thickness H of the ground electrode base material 7 is equal to or less than 1.6 mm. This setting enables the ground electrode body Eg to possess a sufficient strength.

Furthermore, when the intrusion length h of the ground electrode 2 is small, the bonding strength between the ground electrode 2 and the ground electrode base material 7 which are welded together is weak.

Furthermore, as described above, the ground electrode 2 and the ground electrode base material 7 are welded together by irradiating the laser beam from the side surface of the ground electrode base material 7. If the intrusion length h of the ground electrode 2 is excessively small, it will be difficult to perform the laser welding operation and accordingly the spark plug P will not be easily manufactured.

Therefore, it is desirable that the intrusion length h of the ground electrode 2 is greater than 0.5 mm (more preferably, greater than 06 mm). This setting assures a sufficient bonding strength between the ground electrode 2 and the ground electrode base material 7. The spark plug P can be easily manufactured.

In other words, to assure easiness in manufacturing the spark plug P and improve the durability of the spark plug P, it is desirable that the ratio h/H of the intrusion length h of the ground electrode 2 to the thickness H of the ground electrode base material 7 satisfies a condition 0.3≦h/H≦0.5 under the condition that H≦1.6 mm and h>0.5 mm. It is further desirable to satisfy the condition h≧0.6 mm.

For example, according to this embodiment, desirable dimensions are given as follows.

The diameter D2 of the center electrode 1 is 2.0 mm. The diameter D1 of the ground electrode 2 is 2.4 mm. The ratio D1/D2 is 1.2. The thickness H of the ground electrode base material 7 is 1.6 mm. The intrusion length h of the ground electrode 2 is 0.7 mm. The ratio h/H is 0.43.

The inventors of this application have experimentally evaluated the durability of the spark plug P having the center electrode body Ec and the ground electrode body Eg according to the first embodiment.

The inventors have prepared various samples of the spark plug P to be tested. Each sample of the spark plug P was installed in an indirect lean burn gas engine that operates according to the Miller cycle.

The inventors have evaluated the durability of the spark plug P by measuring the required discharge voltage under the condition that the gas engine is operating.

The upper limit value of the required discharge voltage was set to 35 kV. When the required discharge voltage is less than 35 kV, the spark plug P is judged as maintaining appropriate performance and is accordingly still usable. When the required discharge voltage exceeds 35 kV, the spark plug P is judged as being unusable.

First, the inventors of this application have evaluated the usable time of the spark plug P in relation to the ratio h/H of the intrusion length h of the ground electrode 2 to the thickness H of the ground electrode base material 7.

The inventors have prepared plural samples of the spark plug P which have the same thickness H (H=1.6 mm) but are differentiated in the ratio h/H (0.2≦h/H≦0.7). Each sample of the spark plug P was installed in a gas engine as described above to evaluate the durability.

Figure 5:
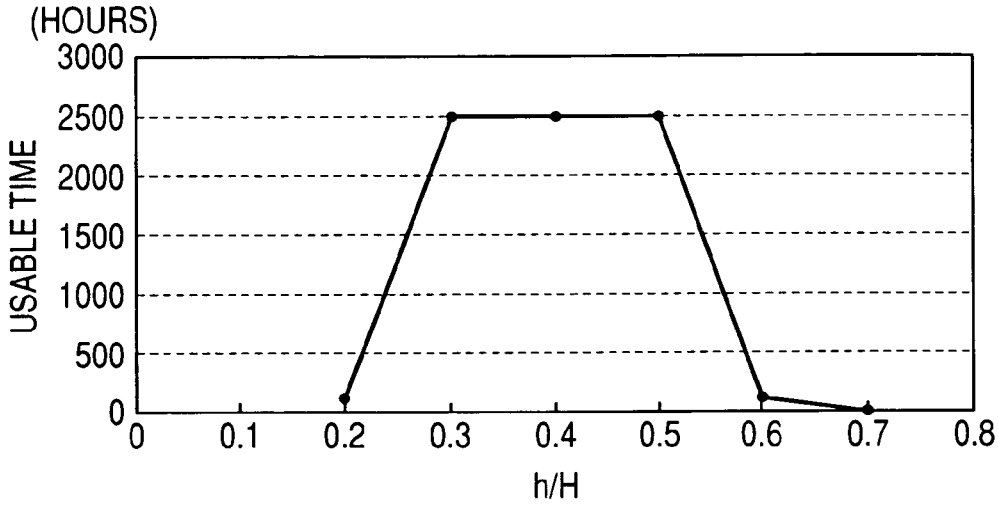
FIG. 5 is a graph showing a relationship between the ratio h/H and the usable time.

FIG. 5 shows the result of conducted evaluation tests.

The spark plug equal to 0.2 in the ratio h/H is insufficient in the strength to hold the ground electrode 2 with the ground electrode base material 7. The ground electrode 2 peels off the ground electrode base material 7 after the passage of approximately 100 hours operation time. According to the spark plug not smaller than 0.6 in the ratio h/H, the ground electrode base material 7 causes a warpage after the passage of approximately 100 hours operation time and as a result the ground electrode 2 falls off the ground electrode base material 7. According to the spark plug having the ratio h/H in the range from 0.3 to 0.5, the required discharge voltage can be suppressed to or less than 35 kV until the operation time reaches 2500 hours. However, once the operation time passes approximately 2500 hours, the required discharge voltage exceeds 35 kV and accordingly the spark plug is no longer usable.

From the above test results, the inventors conclude that the ratio h/H of the intrusion length h of the ground electrode 2 to the thickness H of the ground electrode base material 7 should satisfy the condition 0.3≦h/H≦0.5. This setting can assure a sufficient strength for holding the ground electrode 2 with the ground electrode base material 7 and also can prevent the ground electrode base material 7 from warping even when it is subjected to high-temperature environments. The durability of the ground electrode body Eg can be improved. Accordingly, the spark plug can possess reliable durability.

Next, the inventors of this application have evaluated the usable time of the spark plug P in relation to the ratio D1/D2 of the diameter D1 of the ground electrode 2 to the diameter D2 of the center electrode 1.

The inventors have prepared plural samples of the spark plug P which have the same diameter D2 (D2=2.0 mm) but are differentiated in the ratio D1/D2 (0.9≦D1/D2≦1.3). Each sample of the spark plug P was installed in a gas engine as described above to evaluate the durability.

Figure 6:
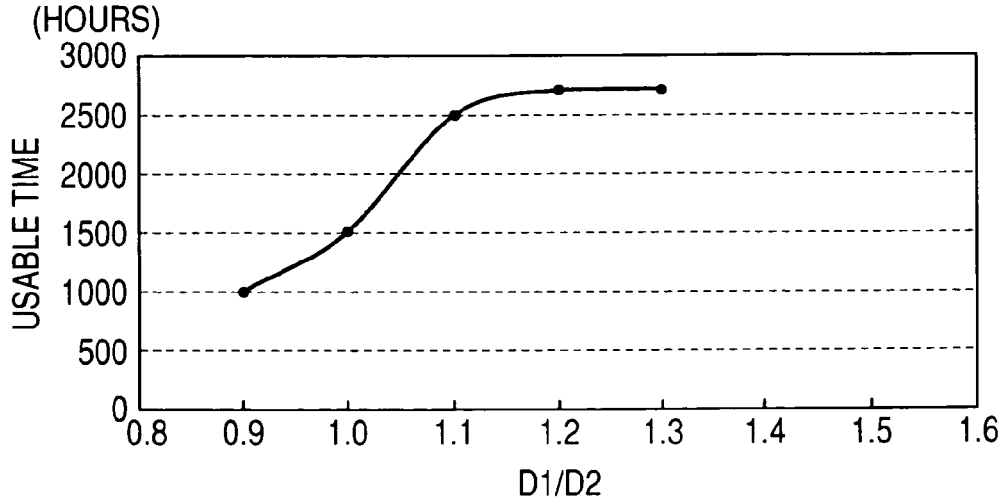
FIG. 6 s a graph showing a relationship between the ratio D1/D2 and the usable time.

FIG. 6 shows the result of conducted evaluation tests.

According to the spark plug equal to 0.9 in the ratio D1/D2, the required discharge voltage exceeds 35 kV after the passage of approximately 1000 hours operation time. According to the spark plug equal to 1.0 in the ratio D1/D2, the required discharge voltage can be suppressed to or less than 35 kV until the operation time reaches 1500 hours. However, once the operation time passes approximately 1500 hours, the required discharge voltage exceeds 35 kV and accordingly the spark plug is no longer usable. According to the spark plug equal to 1.1 in the ratio D1/D2, the required discharge voltage can be suppressed to or less than 35 kV until the operation time reaches 2500 hours. However, once the operation time passes approximately 2500 hours, the required discharge voltage exceeds 35 kV and accordingly the spark plug is no longer usable. The durability (i.e. the usable time) of the spark plug remains unchanged even if the ratio D1/D2 is set to a value equal to or larger than 1.2.

From the above test results, the inventors conclude that the ratio D1/D2 of the diameter D1 of the ground electrode 2 to the diameter D2 of the center electrode 1 should satisfy the condition D1/D2≧1.1. This setting can assure a sufficiently large diameter for the ground electrode 2 and also prevent the required discharge voltage from initially becoming a high value. It becomes possible to prevent the spark discharge from occurring between the center electrode 1 and the ground electrode base material 7. This effectively prevents the ground electrode base material 7 from wearing during the operation of the engine. Thus, it becomes possible to prevent the required discharge voltage from increasing even when the spark plug is used for a long time. The durability of the spark plug can be improved.

Hereinafter, second to fourth embodiments of the present invention will be explained. These embodiments are fundamentally identical with the above-described first embodiment except for the center electrode body Ec and the ground electrode body Eg. Therefore, the components or portions identical with those disclosed in the first embodiment are denoted by the same reference numerals and will not be explained again.

Second Embodiment

Hereinafter, a second embodiment of the present invention will be explained with reference to the attached drawings.

In the second embodiment, like the first embodiment, the ratio D1/D2 of the diameter D1 of the ground electrode 2 to the diameter D2 of the center electrode 1 is set to a value satisfying the condition 1.1≦D1/D2≦1.2 when the diameter D2 of the center electrode 1 is 2.0 mm. Furthermore, the ratio h/H of the intrusion length h of the ground electrode 2 to the thickness H of the ground electrode base material 7 is set to a value satisfying the condition 0.3≦h/H≦0.5 when the thickness H is not greater than 1.6 mm (i.e. H≦1.6 mm) and the intrusion length h is greater than 0.5 mm (i.e. h>0.5 mm).

Figure 7:
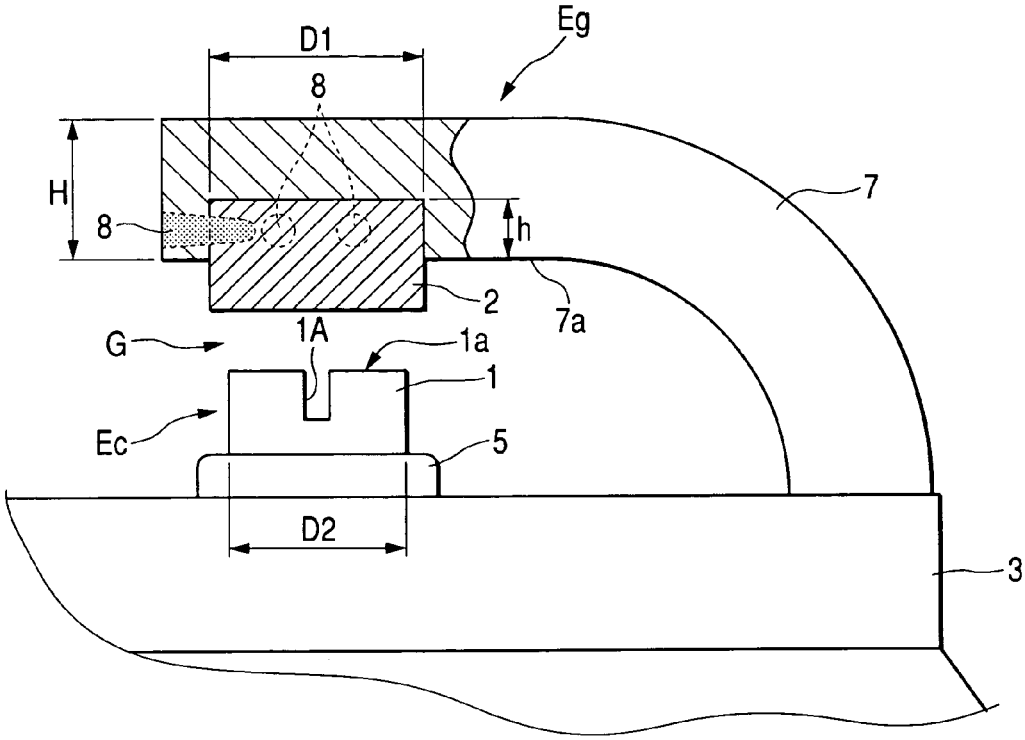
FIG. 7 is an enlarged side view showing a center electrode body and a ground electrode body of the spark plug for a gas engine in accordance with a second embodiment of the present invention.
Figure 8:
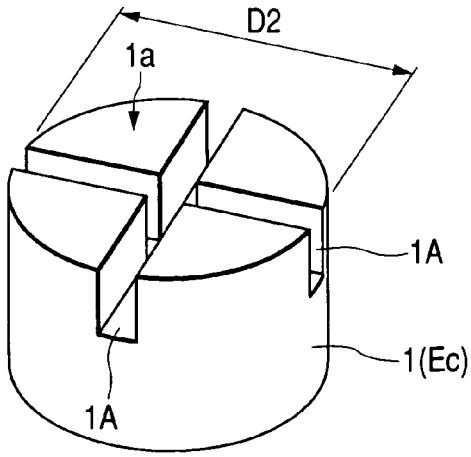
FIG. 8 is a perspective view showing the center electrode of the spark plug for a gas engine in accordance with the second embodiment of the present invention.

In addition to the above settings, the second embodiment is characterized in that, as shown in FIGS. 7 and 8, a groove 1A is formed on a top surface 1 a of the center electrode 1 opposing to the ground electrode 2.

The groove 1A, which is a cross-shaped groove, has straight grooves crossing each other at the center of the top surface 1*a* of the center electrode 1 and entirely extending across the cylindrical center electrode 1 and reaching the peripheral end the cylindrical center electrode 1.

According to the second embodiment, like the first embodiment, the durability of the spark plug P can be improved.

The spark discharge occurs from any angled or edged portion formed along the groove 1A as well as the angled or edged portion in the periphery of the top surface la of the center electrode 1. Accordingly, the spark discharge occurs at numerous portions. This is effective in improving the ignitability of the spark plug.

Third Embodiment

Figure 9:
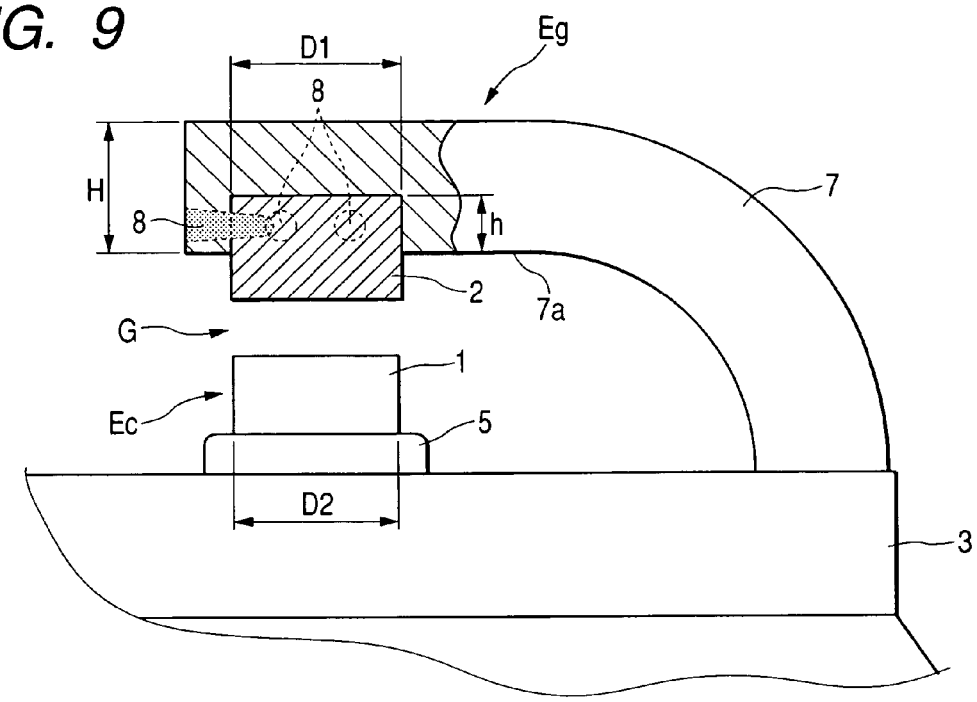
FIG. 9 is an enlarged side view showing a center electrode body and a ground electrode body of the spark plug for a gas engine in accordance with a third embodiment of the present invention.

Hereinafter, a third embodiment of the present invention will be explained with reference to FIG. 9.

In the third embodiment, like the first embodiment, the ratio h/H of the intrusion length h of the ground electrode 2 to the thickness H of the ground electrode base material 7 is set to a value satisfying the condition 0.3≦h/H≦0.5 when the thickness H is not greater than 1.6 mm (i.e. H≦1.6 mm) and the intrusion length h is greater than 0.5 mm (i.e. h>0.5 mm). Meanwhile, the third embodiment is different from the first embodiment in that the ratio D1/D2 of the diameter D1 of the ground electrode 2 to the diameter D2 of the center electrode 1 satisfies the condition D1/D2<1.1.

As explained in the first embodiment, when the ratio D1/D2 of the diameter D1 of the ground electrode 2 to the diameter D2 of the center electrode 1 is smaller than 1.1, the durability of the spark plug goes worse. Therefore, it is desirable that the ratio D1/D2 is a value adjacent to 1.1 (e.g. 1.05).

For example, according to this embodiment, desirable dimensions are given as follows.

The diameter D2 of the center electrode 1 is 2.0 mm. The diameter D1 of the ground electrode 2 is 2.1 mm. The ratio D1/D2 is 1.05. The thickness H of the ground electrode base material 7 is 1.6 mm. The intrusion length h of the ground electrode 2 is 0.7 mm. The ratio h/H is 0.43.

As apparent from the foregoing description, the spark plug of the third embodiment satisfies the condition 0.3≦h/H≦0.5 in the ratio h/H of the intrusion length h of the ground electrode 2 to the thickness H of the ground electrode base material 7 when the thickness H is not greater than 1.6 mm (i.e. H≦1.6 mm) and the intrusion length h is greater than 0.5 mm (i.e. h>0.5 mm). Accordingly, as explained in the first embodiment, the durability of the spark plug can be improved.

Fourth Embodiment

Figure 10:
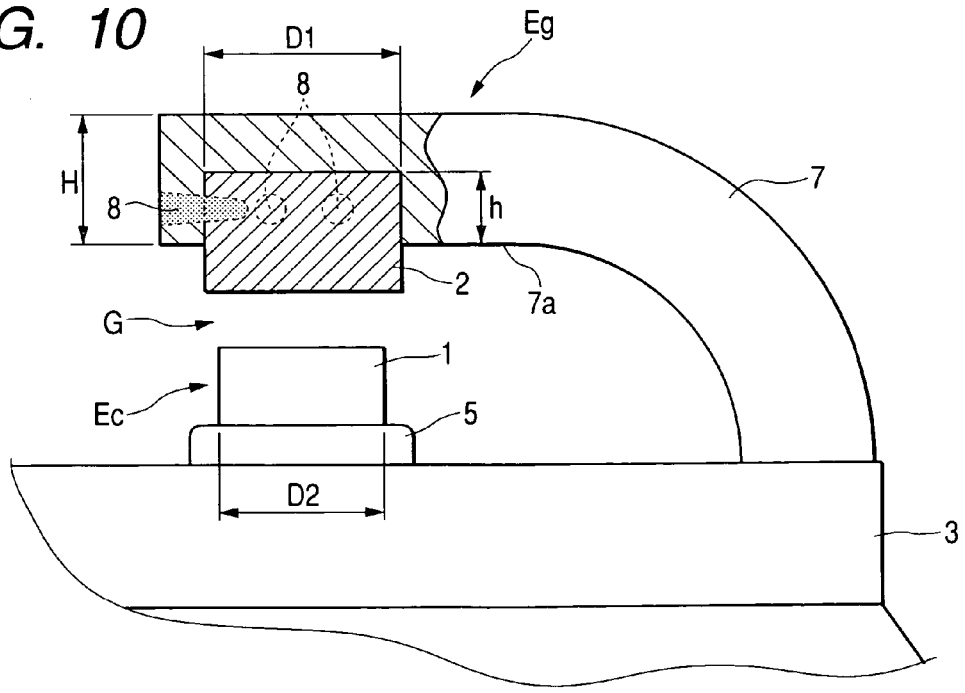
FIG. 10 is an enlarged side view showing a center electrode body and a ground electrode body of the spark plug for a gas engine in accordance with a fourth embodiment of the present invention.

Hereinafter, a fourth embodiment of the present invention will be explained with reference to FIG. 10.

In the fourth embodiment, like the first embodiment, the ratio D1/D2 of the diameter D1 of the ground electrode 2 to the diameter D2 of the center electrode 1 is set to a value satisfying the condition 1.1≦D1/D2≦1.2 when the diameter D2 of the center electrode 1 is 2.0 mm. However, the fourth embodiment is different from the first embodiment in that the ratio h/H of the intrusion length h of the ground electrode 2 to the thickness H of the ground electrode base material 7 is set to a value satisfying the condition h/H>0.5.

As explained in the first embodiment, when the ratio h/H of the intrusion length h of the ground electrode 2 to the thickness H of the ground electrode base material 7 is greater than 0.5, the durability of the spark plug goes worse. Therefore, it is desirable that the ratio h/H is a value adjacent to 0.5 (e.g. 0.55).

For example, according to this embodiment, desirable dimensions are given as follows.

The diameter D2 of the center electrode 1 is 2.0 mm. The diameter D1 of the ground electrode 2 is 2.4 mm. The ratio D1/D2 is 1.2. The thickness H of the ground electrode base material 7 is 1.6 mm. The intrusion length h of the ground electrode 2 is 0.88 mm. The ratio h/H is 0.55.

As apparent from the foregoing description, the spark plug of the fourth embodiment satisfies the condition $1.1 \leqq D1/D2 \leqq 1.2$ in the ratio D1/D2 of the diameter D1 of the ground electrode 2 to the diameter D2 of the center electrode 1 when the diameter D2 of the center electrode 1 is 2.0 mm. Accordingly, as explained in the first embodiment, the durability of the spark plug can be improved.

Other Embodiments

The present invention can be modified in various ways.

(I) The material for the ground electrode 2 or the center electrode 1 is an alloy containing Ir as a main component. The composition of this alloy is not limited to the one disclosed in the above embodiments. For example, it is possible to use an alloy containing Rh as an additive when this alloy chiefly contains Ir.

Furthermore, it is possible to use an alloy containing Ir as a main component and at least one additive selected from the group consisting of Rh, Pt (platinum), Ni (nickel), Pd (palladium), W (tungsten), Ru (ruthenium), and Os (osmium).

In this case, under the condition that Ir has a largest content, it is desirable that Rh and Pt have a content equal to or less than 50%, Ni and Pd have a content equal to or less than 40%, W and Ru have a content equal to or less than 30%, and Os has a content equal to or less than 20%. The durability of the ground electrode 2 or the center electrode 1 can be improved.

Furthermore, instead of forming the ground electrode 2 or the center electrode 1 by using the material containing Ir as a main component, it is possible to use an alloy containing Pt as a main component. For example, when an alloy containing Pt as a main component can further contain at least one additive selected from the group consisting of Ir, Rh, Ni, Pd, W, Ru, and Os. In this case, under the condition that Pt has a largest content, it is desirable that Ir and Rh have a content equal to or less than 50%, Ni and Pd have a content equal to or less than 40%, W and Ru have a content equal to or less than 30%, and Os has a content equal to or less than 20%. The durability of the ground electrode 2 or the center electrode 1 can be improved.

(II) In welding the ground electrode 2 to the ground electrode base material 7, it is not always necessary to irradiate the laser beam to plural portions on the side surface of the ground electrode base material 7. For example, it is possible to irradiate the laser beam to plural portions on a back surface of the ground electrode base material 7 opposite to the inner surface 7*a* opposing to the center electrode body Ec. In this case, the fused portion 8 formed by the laser welding extends vertically (i.e. in the axial direction of the spark plug) from the ground electrode base material 7 to the ground electrode 2.

Furthermore, it is possible to combine the laser welding operation applied from the side surface of the ground electrode base material 7 to form the laterally extending fused portions 8 with the laser welding operation applied from the back surface of the ground electrode base material 7 to form the vertically extending fused portions 8.

(III) In manufacturing the ground electrode 2 with the ground electrode base material 7, the welding operation is not limited to the laser welding operation. For example, it is possible to use the resistance welding operation or the plasma welding operation.

(IV) The diameter D2 of the center electrode 1 is not limited to a value equal to or less than 2.0 mm. Therefore, it is possible to set the diameter D2 to be greater than 2.0 mm.

Furthermore, the thickness H of the ground electrode base material 7 is not limited to a value equal to or less than 1.6 mm. Therefore, it is possible to set the thickness H to be greater than 1.6 mm.

(V) In the second embodiment, the groove 1A is formed on the top surface la of the center electrode 1 opposing to the ground electrode 2. In this case, the groove 1A is not limited to the shape disclosed in the second embodiment. For example, it is possible to form two or more parallel grooves or a Y-shaped groove. It is also possible to form the groove 1A having an edge not reaching the periphery of the cylindrical center electrode 1. Furthermore, the groove IA can be configured into a circular or rectangular shape.

(VI) In the third or fourth embodiment, like the second embodiment, it is desirable to form the groove 1A on the top surface 1*a* of the center electrode 1 opposing to the ground electrode 2.

(VII) In the fourth embodiment, instead of setting the ratio h/H of the intrusion length h of the ground electrode 2 to the thickness H of the ground electrode base material 7 to a value satisfying the condition $h/H>0.5$, it is possible to set the ratio h/H so as to satisfy the condition $h/H<0.3$. In this case, as explained in the first embodiment, the durability of the spark plug goes worse when the h/H is less than 0.3. Therefore, it is desirable that the ratio h/H is a value adjacent to 0.3 (e.g. 0.25).

(VIII) The spark plug of this invention is not limited to the Miller cycle engine and accordingly can be applied to any other indirect lean burn gas engines. For example, an ordinary engine not employing the Miller cycle may close the intake valve 16 when the piston 12 almost reaches the bottom dead center. Moreover, it is possible to use a gas engine not equipped with a sub combustion chamber or a gas engine using a gas mixture adjacent to 1 in the excess air ratio $\lambda$.

What is claimed is:

1. A spark plug for a gas engine comprising a ground electrode body and a center electrode body, wherein a ground electrode of said ground electrode body is welded on a surface of a ground electrode base material opposing to said center electrode body;

said ground electrode of said ground electrode body protrudes toward said center electrode body;

said ground electrode is made of a material containing iridium or platinum as a main component;

said ground electrode base material is made of a heat-resistant nickel alloy;

said ground electrode is impacted in a recess of said ground electrode base material; and said spark plug satisfies the condition $0.3 \leqq h/H \leqq 0.5$ when H represents a thickness of said ground electrode base material in an intrusion direction of said ground electrode, and h represents an intrusion length of said ground electrode that defines a length of said ground electrode impacted in said ground electrode base material in said intrusion direction.

2. The spark plug for a gas engine in accordance with claim 1, further satisfying a condition $h>0.5$ mm.

3. The spark plug for a gas engine in accordance with claim 1, wherein said ground electrode is bonded to said ground electrode base material by laser welding.

4. The spark plug for a gas engine in accordance with claim 1, wherein said ground electrode is joined to said ground electrode base material through at least one fused portion in which materials of said ground electrode and said ground electrode base material are melted together.

5. The spark plug for a gas engine in accordance with claim 1, wherein said fused portion is formed by laser welding.

6. The spark plug for a gas engine in accordance with claim 4, wherein said at least one fused portion extends in a direction generally perpendicular to said intrusion direction of said ground electrode.

7. The spark plug for a gas engine in accordance with claim 1, wherein said ground electrode has a substantially constant outer diameter.

8. The spark plug for a gas engine in accordance with claim 7, wherein said fused portion is formed by laser welding.

9. The spark plug for a gas engine in accordance with claim 7, wherein said at least one fused portion extends in a direction generally perpendicular to said intrusion direction of said ground electrode.

10. A spark plug for a gas engine comprising a ground electrode body and a center electrode body, wherein a ground electrode of said ground electrode body and a center electrode of said center electrode body are made of a material containing iridium or platinum as a main component;

said ground electrode protrudes toward said center electrode body;

said ground electrode base material is made of a heat-resistant nickel alloy;

said ground electrode is impacted in a recess of said ground electrode base material; and said spark plug satisfies the conditions $D1/D2 \geqq 1.1$ and $0.3 \leqq h/H \leqq 0.5$ when D1 represents a diameter of said ground electrode, D2 represents a diameter of said center electrode, H represents a thickness of said ground electrode base material in an intrusion direction of said ground electrode, and h represents an intrusion length of said ground electrode that defines a length of said ground electrode impacted in said ground electrode base material in said intrusion direction.

11. The spark plug for a gas engine in accordance with claim 10, further satisfying a condition $h>0.5$ mm.

12. The spark plug for a gas engine in accordance with claim 10, wherein said ground electrode is bonded to said ground electrode base material by laser welding.

13. The spark plug for a gas engine in accordance with claim 10, wherein said center electrode has a surface opposing to said ground electrode, and a groove is formed on said surface of said center electrode.

14. The spark plug for a gas engine in accordance with claim 10, wherein said ground electrode is joined to said ground electrode base material through at least one fused portion in which materials of said ground electrode and said ground electrode base material are melted together.

15. The spark plug for a gas engine in accordance with claim 10, wherein said ground electrode has a substantially constant outer diameter.

* * * * *